US006236003B1

(12) United States Patent
Suganami

(10) Patent No.: US 6,236,003 B1
(45) Date of Patent: May 22, 2001

(54) KEYBOARD ASSEMBLY SUPERIOR IN ASSEMBLABILITY

(75) Inventor: Shoji Suganami, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/431,829

(22) Filed: Nov. 2, 1999

(30) Foreign Application Priority Data

Nov. 5, 1998 (JP) ..... 10-314279

(51) Int. Cl.[7] ..... H01H 13/70
(52) U.S. Cl. ..... 200/5 A; 200/344
(58) Field of Search ..... 200/5 A, 517, 200/344, 345; 400/490, 491, 491.2, 495, 495.1, 496

(56) References Cited

U.S. PATENT DOCUMENTS

| | | | | |
|---|---|---|---|---|
| 5,463,195 | | 10/1995 | Watanabe et al. | 200/5 A |
| 6,020,565 | * | 2/2000 | Pan | 200/344 |
| 6,064,020 | * | 5/2000 | Yamada et al. | 200/344 |
| 6,087,604 | * | 7/2000 | Suga et al. | 200/344 |

* cited by examiner

*Primary Examiner*—Michael Friedhofer
(74) *Attorney, Agent, or Firm*—Brinks Hofer Gilson & Lione

(57) ABSTRACT

In the keyboard assembly, a narrow portion of a first retaining portion of a first lever is inserted into a second gap through a first gap of a first engaging portion formed on a substrate. Thus, the keyboard assembly of the present invention is superior in its assembling work efficiency.

9 Claims, 7 Drawing Sheets

KEYBOARD ASSEMBLY SUPERIOR IN ASSEMBLABILITY

BACKGROUND OF THE INVENTION

1. Field of the Invention

The present invention relates to a keyboard assembly, particularly a keyboard assembly suitable for use in an input device such as a word processor or a personal computer.

2. Description of the Related Art

A conventional keyboard assembly used in such an input device is shown in FIGS. 10 and 11. As shown in both figures, a membrane switch is placed on a support plate (not shown), the membrane switch comprising a lower sheet 50 having a fixed contact (not shown) on a lower side thereof and a flexible upper sheet 52 having a movable contact (not shown) and disposed on the lower sheet 50 through an insulating spacer 51.

A support member 53 formed of a resin material is disposed on the membrane switch. The support member 53 is provided with two engaging portions 53*a* each having an engaging portion 53*b* and formed on the left-hand side in the figures and is also provided with engaging portions 53*c* each having an engaging hole 53*d* and formed on the right-hand side.

A hole 53*e* is formed between the left- and right-hand side engaging portions 53*a*, 53*c*.

A first lever 54 formed of a resin material is provided with a pair of arm portions 54*c* and a pair of arm portions 54*d*, each pair having a pair of columnar protrusions 54*a* and 54*b* at end portions thereof, with outwardly projecting pivot shaft portions 54*e* being formed at central positions of the arm portions 54*c* and 54*d*. The protrusions 54*b* are pivotably engaged respectively with the engaging portions 53*d* of the support member 53.

Outside the first lever 54 is disposed a second lever 55 formed of a resin material. As shown in FIG. 11, the second lever 55 comprises a connecting portion 55*a* positioned on the right-hand side and a pair of arm portions 55*b* extending leftwards respectively from upper and lower ends of the connecting portion 55*a*. The second lever 55 is formed in a generally turned square U-shape.

At both ends of the connecting portion 55*a* are formed outwardly projecting columnar protrusions 55*c* respectively, and at the left-hand ends of the paired arm portions 55*b* are formed outwardly projecting columnar protrusions 55*d* respectively. A generally elliptic recess 55*e* is formed centrally in each of the paired arm portions 55*b*. The protrusions 55*d* are pivotably engaged respectively with the engaging portions 53*a* of the support member 53, and the pivot shaft portions 54*e* of the first lever 54 are fitted in the recesses 55*e* respectively. In this way the first and second levers 54, 55 are assembled crosswise.

For mounting the first and second levers 54, 55 to the engaging portions 53*a* and 53*c* of the support member 53, the first and second levers 54, 55 are held in the crosswise assembled state, and in this state the protrusions 54*b* are fitted in the engaging holes 53*d* of the engaging portions 53*c* while expanding the arm portions 54*d* of the first lever 54 outwards.

Further, the arm portions 55*b* of the second lever 55 are narrowed on the side where the protrusions 55*d* are formed, by applying a force to the arm portions inwards, and the protrusions 55*d* are allowed to fit in the engaging holes 53*b* of the engaging portions 53*a*, whereby the first and second levers 54, 55 can be secured pivotably to the support member 53.

A key top 56 is formed using a resin material, and on the left-hand side of the back of the key top 56 are formed a pair of holding portions 56*b* in an opposed relation to each other, with slide grooves 56*a* being formed outwards in the paired holding portions 56*b* respectively. On the right-hand side of the back of the key top 56 are formed a pair of holding portions 56*d*, with slide grooves 56*c* being formed inwards and opposedly to each other in the holding portions 56*d* respectively.

The protrusions 54*a* of the first lever 54 are slidably held respectively by the left-hand holding portions 56*b*, while the protrusions 55*c* of the second lever 55 are slidably held respectively by the second lever 55, whereby the key top 56 is mounted vertically to be movable on the first and second levers 54, 55.

A domed elastic member 57 formed of an insulating rubber is placed on the membrane switch while being positioned within the hole 53*e* of the support member 53. An upper end portion of the elastic member 57 is in abutment with the back side of the key top 56.

The first and second levers 54, 55, the key top 56 attached to the levers 54, 55, and the elastic member 57 are arranged in plural rows on the membrane switch to constitute the conventional keyboard assembly.

The conventional keyboard assembly thus constructed operates in the following manner. When the key top 56 is brought down, the first and second levers 54, 55 move pivotally about the protrusions 54*b* and 55*d* which are engaged with the engaging portions 53*a* and 53*c* formed on the support member 53 side, so that the pivot shaft portions 54*e* of the first lever 54 move respectively within the generally elliptic recesses 55*e* of the second lever 55, and the first and second levers 54, 55 pivotally move downward while the protrusions 54*a* and 55*c* slide respectively within the slide grooves 56*a* and 56*c* formed on the key top 56 side. The key top 56 is adapted to move down with such pivotal downward movement of the first and second levers 54, 55.

As a result of such downward movement of the key top 56, the elastic member 57 is pressed and collapsed and inverted into a dome shape, whereupon the upper sheet, or a switch substrate, 52 is pushed by an inner projection 57*a* of the elastic member 57 and a circuit contact formed on the switch substrate 52 comes into contact with an electric conductor on the lower sheet, or an insulating substrate, 50 to turn ON the membrane switch.

Upon subsequent relief of the pressure on the key top 56, the first and second levers 54, 55 and the key top 56 are forced back to the respective states before the pressing by the elastic force of the elastic member 57, and the switch substrate 52 which has been pressed down by the elastic member 57 moves out of contact with the insulating substrate 50 and reverts to its initial state by virtue of its own restoring force, so that the membrane switch turns OFF.

In the above conventional keyboard assembly, however, when mounting the first and second levers 54, 55 to the support member 53, the respective protrusions 54*b* and 55*d* are attached to the support member 53 while expanding the arm portions 54*d* of the first lever 54 outwards or narrowing the arm portions 55*b* of the second lever 55 inwards, thus giving rise to the problem that the assembling work efficiency is deteriorated.

SUMMARY OF THE INVENTION

It is an object of the present invention to provide a keyboard assembly which permits an efficient mounting of the first and second levers 54, 55 and which is superior in assemblability.

According to the first means adopted by the present invention for achieving the above-mentioned object there is provided a keyboard assembly including a key top having first and second engaging portions and held vertically movably on a substrate which has first and second engaging portions, an elastic member which urges the key top upward, and first and second levers which hold the key top vertically movably, the first and second levers being combined together crosswise through a pivot shaft portion formed between one ends and opposite ends of the first and second levers respectively, the first lever having a first retaining portion for pivotable engagement of one end of the first lever with the first engaging portion of the substrate and also having a second retaining portion for slidable engagement of the opposite end of the first lever with the second engaging portion of the key top, the second lever having a first retaining portion for pivotable engagement of one end of the second lever with the first engaging portion of the key top and also having a second retaining portion for slidable engagement of the opposite end of the second lever with the second engaging portion of the substrate, the first engaging portion(s) of the substrate and/or the key top comprising two engaging walls opposed to each other through a gap, the first retaining portion(s) of the first lever and/or the second lever being inserted through the gap into pivotable engagement with the first engaging portion(s) of the substrate and/or the key top.

According to the second means adopted by the present invention for achieving the foregoing object, the first retaining portion(s) of the first lever and/or the second lever is formed in an oval shape having a narrow portion and a wide portion, the narrow portion(s) being formed in parallel with the longitudinal direction of the first lever and/or the second lever, the wide portion(s) being formed perpendicularly to the longitudinal direction of the first lever and/or the second lever, the narrow portion(s) being inserted through the gap(s) of the first engaging portion(s) of the substrate and/or the key top and the wide portion(s) being brought into pivotable engagement with the first engaging portion(s).

According to the third means adopted by the present invention for achieving the foregoing object, the first engaging portion(s) of the substrate and/or the key top comprises a first gap into which the narrow portion(s) of the first retaining portion(s) of the first lever and/or the second lever can be inserted and a second gap which is wider than the first gap and in which the wide portion(s) of the first retaining portion(s) is pivotable.

According to the fourth means adopted by the present invention for achieving the foregoing object, the narrow portion(s) of the first retaining portion(s) of the first lever and/or the second lever is inserted from the first gap(s) into the second gap(s) of the first engaging portion(s) of the substrate and/or the key top, and the wide portion(s) of the first lever and/or the second lever is brought into pivotable engagement with the second gap(s) of the first engaging portion(s) of the substrate and/or the key top.

DETAILED DESCRIPTION OF A PREFERRED EMBODIMENT

Figure 1:
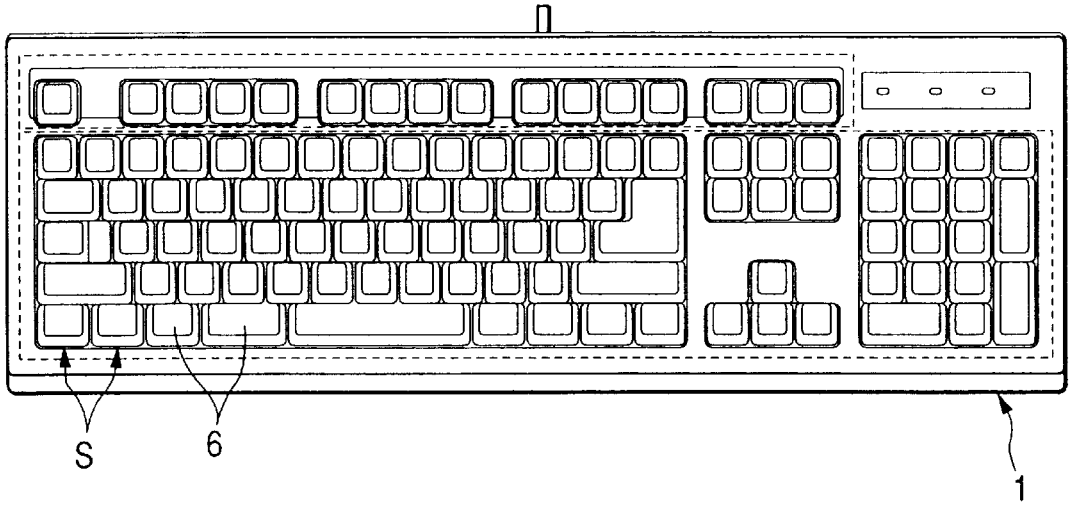
FIG. 1. is a plan view of a keyboard assembly embodying the present invention.
Figure 2:
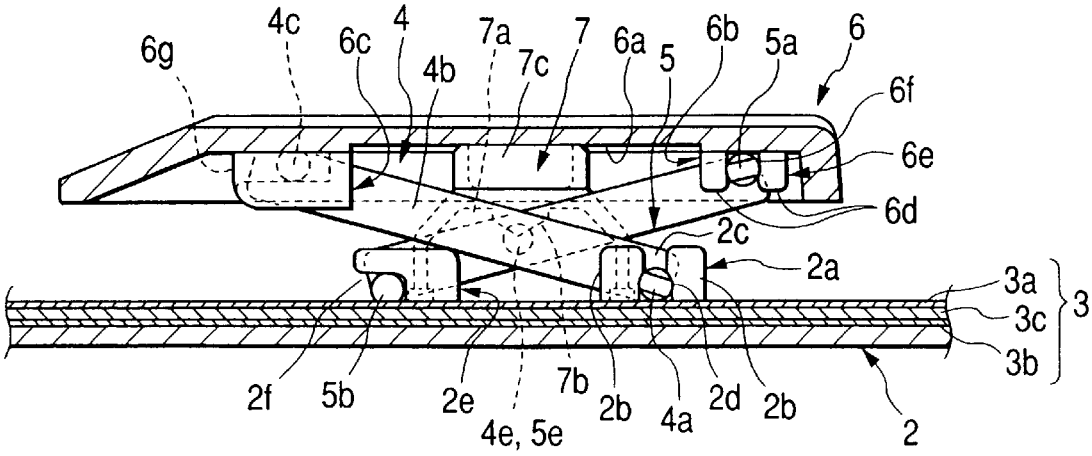
FIG. 2. is a sectional side view of a key switch used in the keyboard assembly.
Figure 3:
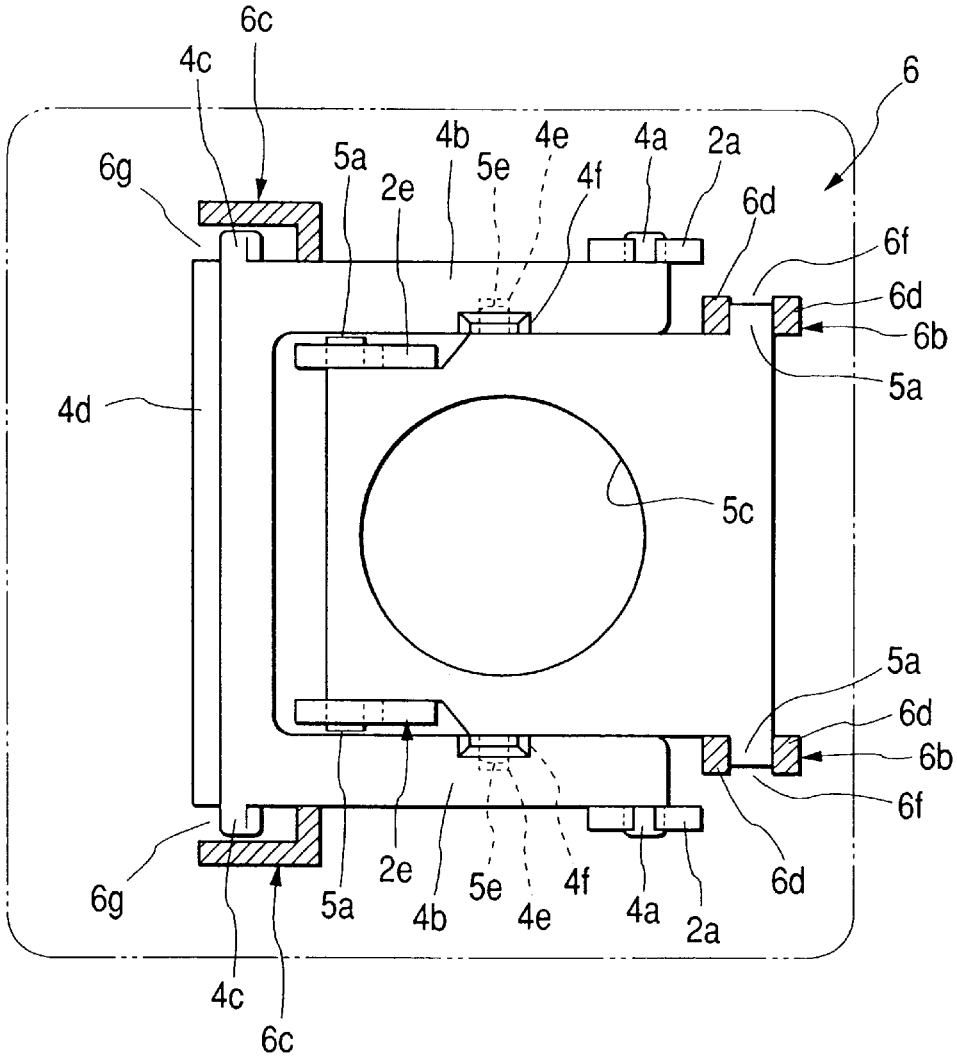
FIG. 3 is a sectional plan view thereof.
Figure 4:
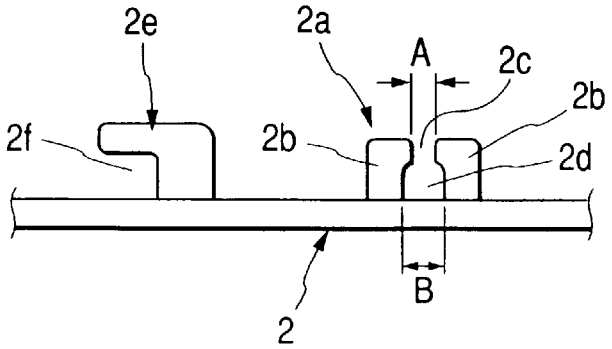
FIG. 4 is a partial side view of a substrate used in the keyboard assembly.
Figure 5A:
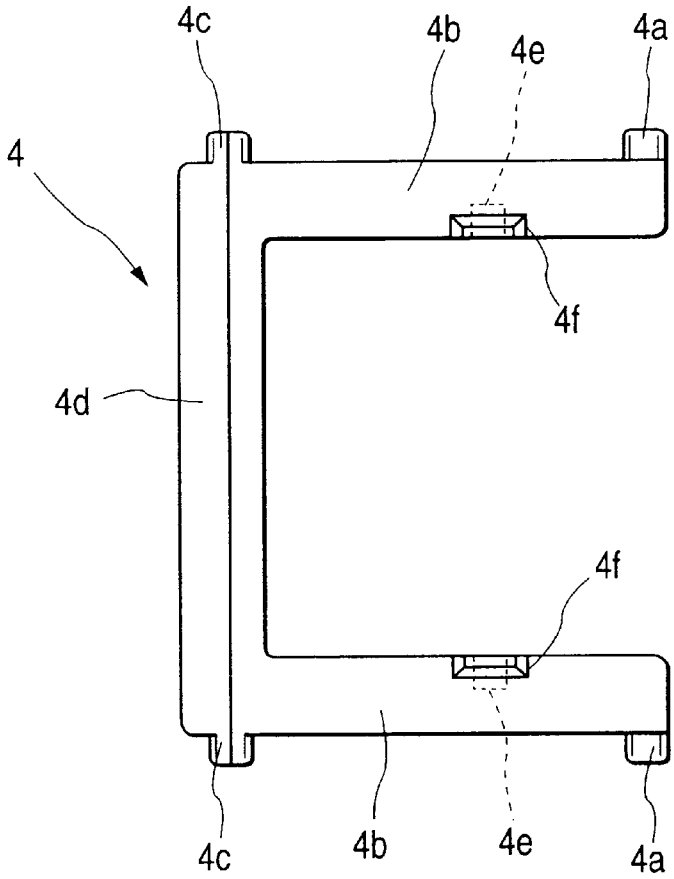
FIG. 5A is a plan view of a first lever used in the keyboard assembly and FIG. 5B is a side view thereof.
Figure 5B:
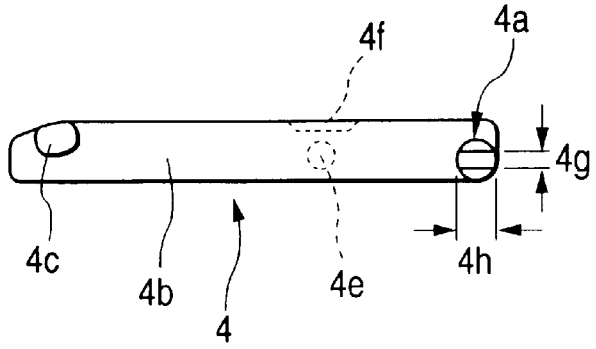
Figure 6A:
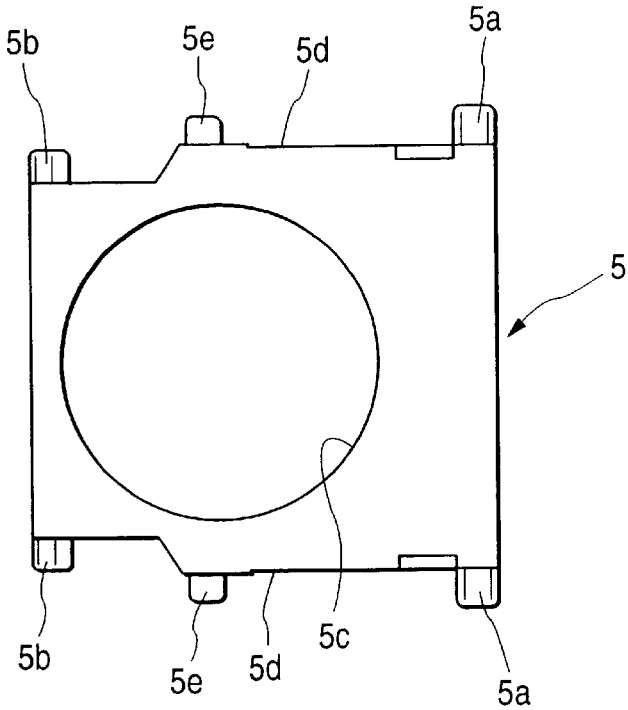
FIG. 6 is a plan view of a second lever used in the keyboard assembly and FIG. 6B is a side view thereof.
Figure 6B:
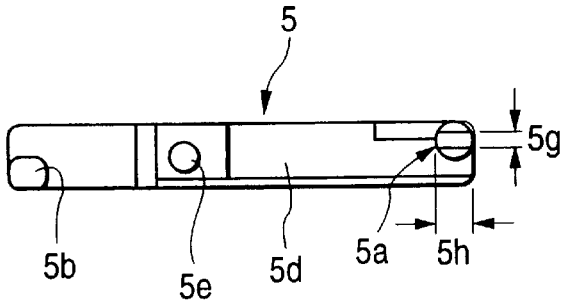
Figure 7:
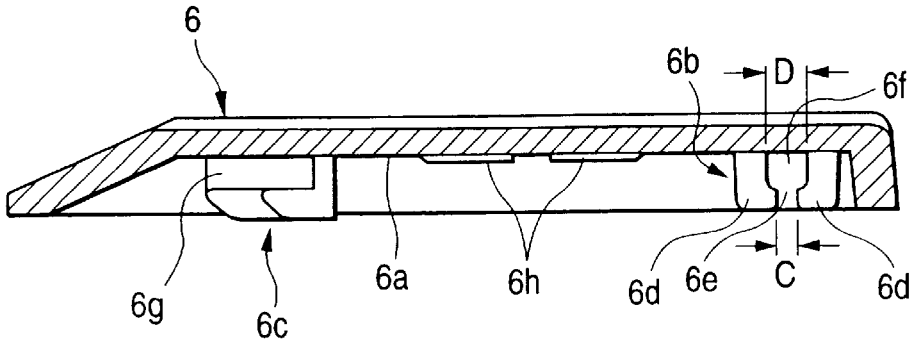
FIG. 7 is a sectional view of a principal portion of a key top used in the keyboard assembly.
Figure 8:
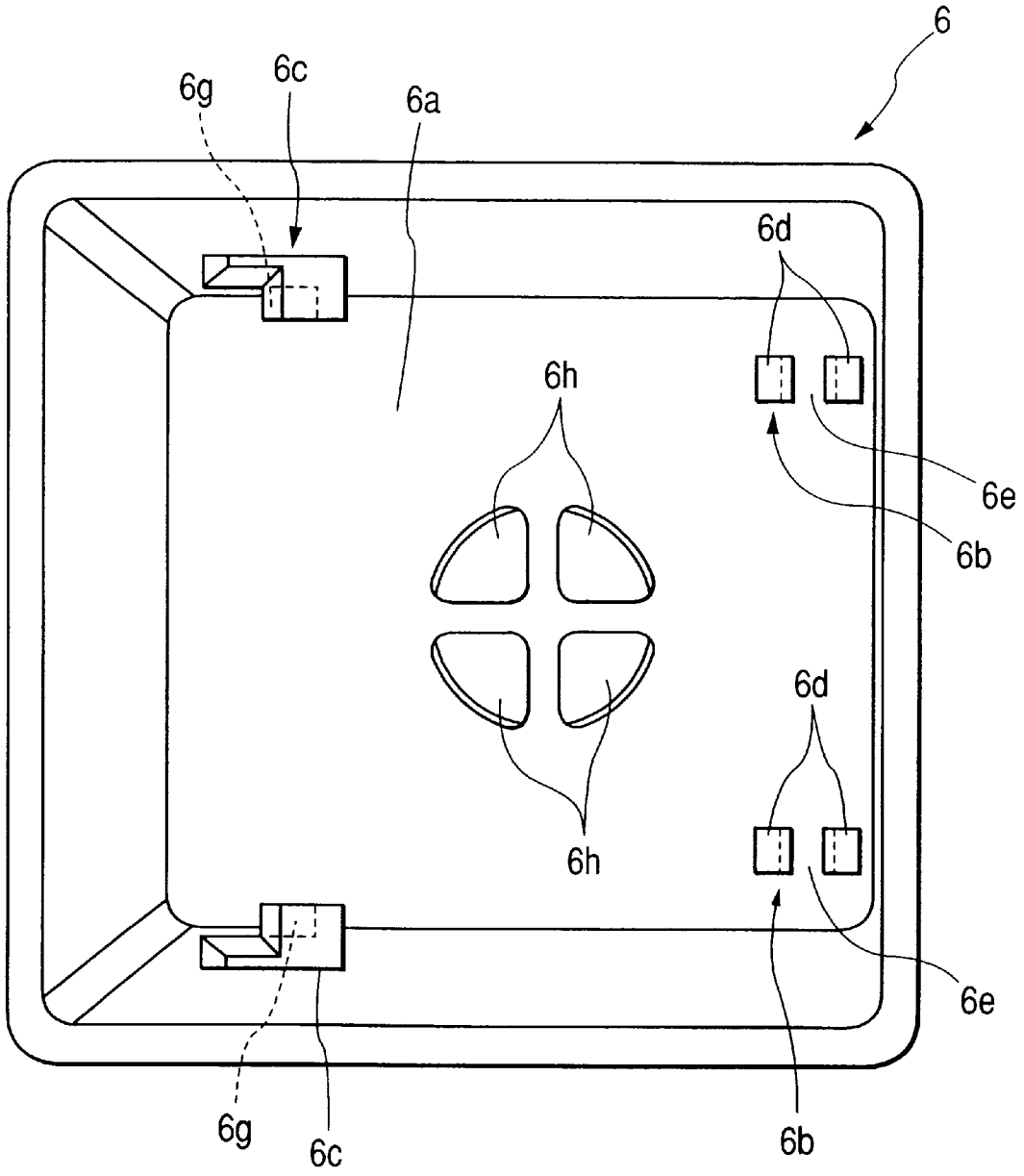
FIG. 8 is a bottom view of the key top.
Figure 9:
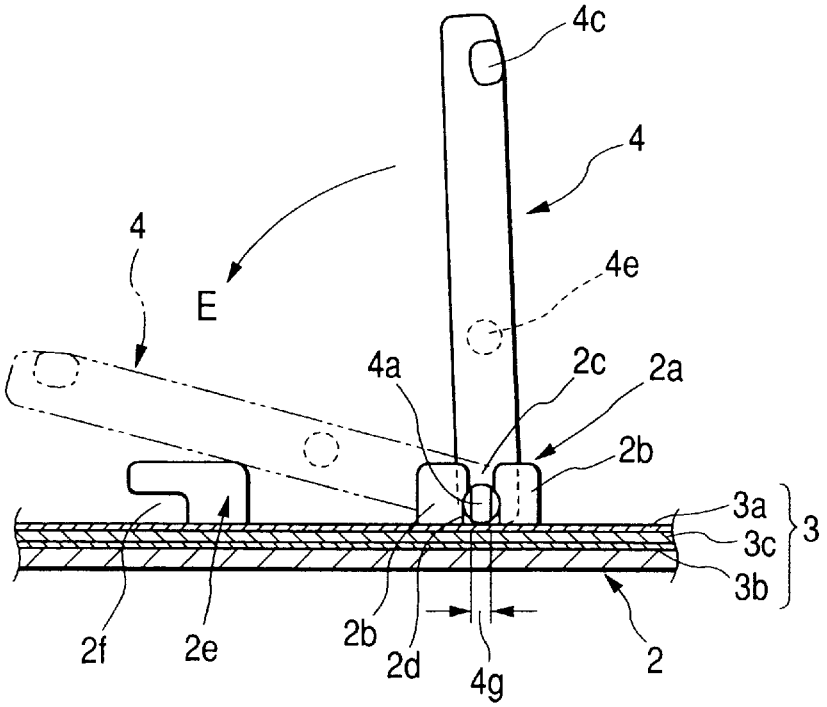
FIG. 9 is a schematic diagram explaining how to assemble the first lever.
Figure 10:
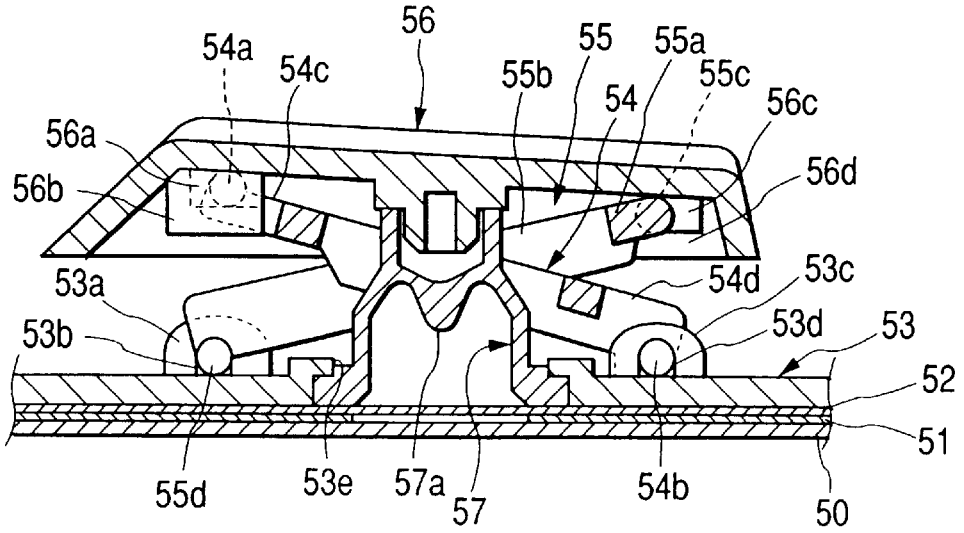
FIG. 10 PRIOR ART
FIG. 10 is a sectional side view of a principal portion of a key switch used in a conventional keyboard assembly.
Figure 11:
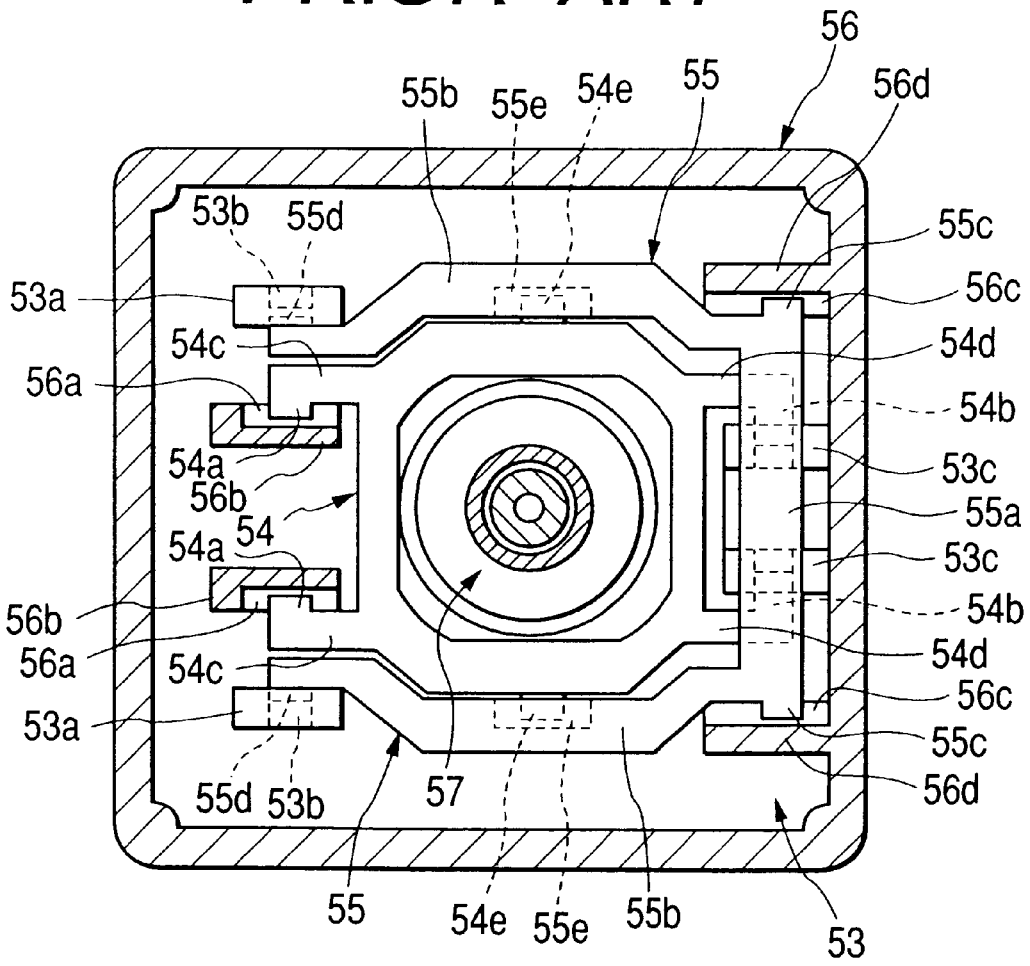
FIG. 11 PRIOR ART
FIG. 11 is a sectional plan view thereof.

A keyboard assembly according to an embodiment of the present invention will be described hereinunder with reference to the accompanying drawings, in which FIG. 1 is a plan view showing the keyboard assembly, FIG. 2 is a sectional view showing a principal portion of a key switch used in the keyboard assembly, FIG. 3 is a sectional plan view thereof, FIG. 4 is a side view of a support member used in the keyboard assembly, FIG. 5A is a plan view of a first lever used in the keyboard assembly and FIG. 5B is a side view thereof, FIG. 6A is a plan view of a second lever used in the keyboard assembly and FIG. 6B is a side view thereof, FIG. 7 is a sectional view of a key top used in the keyboard assembly, FIG. 8 is a bottom view thereof, and FIG. 9 is a diagram explaining a method for mounting the first lever to a substrate. As shown in FIG. 1, the keyboard assembly embodying the present invention comprises a housing 1 and a plurality of switches S arranged in the housing. At the bottom of each key switch S is disposed a substrate 2 having first and second engaging portions 2*a*, 2*e*, as shown in FIG. 2. The substrate 2 is constituted by a flat metallic plate such as an aluminum plate and is partially cut and raised by a pressing work for example to form the first and second engaging portions 2*a*, 2*e*, as shown in FIG. 4.

The first engaging portion 2*a* comprises two engaging walls 2*b* which are formed opposedly to each other so as to define therebetween a first gap 2*c* of width A and a second gap 2*d* of a larger width B.

The second engaging portion 2*e* located on the left-hand side of the first engaging portion 2*a* is formed in a generally L shape, one side of which is open to define a slide slot 2*f*.

As shown in FIG. 3, the first and second engaging portions 2*a*, 2*e* are each formed in a pair at upper and lower positions.

A membrane switch 3, which is placed on the substrate 2, comprises an upper sheet 3*a* having flexibility and a lower sheet 3*b*, with a spacer 3*c* being disposed between the upper and lower sheets 3*a*, 3*b*. The upper and lower sheets 3*a*, 3*b* are disposed so that a movable contact (not shown) formed on the lower surface of the upper sheet is opposed to a fixed contact (not shown) formed on the upper surface of the lower sheet.

Holes (not shown) through which the first and second engaging portions 2*a*, 2*e* formed on the substrate 2 can pass are formed in the upper sheet 3*a*, lower sheet 3*b* and spacer 3*c* which constitute the membrane switch 3. The first and second engaging portions 2*a* and 2*e* are inserted into the holes, whereby the membrane switch 3 is established its position and placed on the substrate 2.

On the membrane switch 3 are disposed first and second levers 4, 5. The first lever 4 is formed of a resin material and, as shown in FIG. 5A, a pair of arm portions 4*b* respectively having first retaining portions 4*a* at one ends thereof located on the right-hand side in the figure extend laterally in an up-down relation and in parallel with each other. The first retaining portions 4*a* are formed as protrusions extending vertically from one right-hand ends of the arm portions 4*b*.

The first lever 4 is further provided with a connecting portion 4*d* for connection between the paired arm portions 4*b*. The connecting portion 4*d* is positioned at the opposite end of the first lever located on the left-hand side in FIG. 5 and extends vertically. The connecting portion 4*d* is formed with a pair of second retaining portions 4*c* extending as protrusions. Thus, the first lever 4 is formed in a generally turned square U-shape in plan, with the right-hand side being open. As shown in FIG. 5B, the first retaining portions 4*a* are each formed in an oval shape having a narrow portion 4*g* and a wide portion 4*h*. The narrow portion 4*g* is formed in parallel with the longitudinal direction of the first lever 4, while the wide portion 4*h* is formed in a direction perpendicular to the longitudinal direction of the first lever 4.

The second retaining portions 4*c* are each formed in a generally elliptic shape whose size is larger in the transverse direction than in the vertical direction.

In positions close to the first retaining portions 4*a* a pair of shaft bearing portions 4*e,* which are circular in section, are formed at predetermined depth and diameter respectively in opposed inner surfaces of the horizontally parallel arm portions 4*b,* and corner portions on the shaft bearing portions 4*e* are chamfered in a predetermined size to form a pair of guide portions 4*f*.

The second lever 5, which is formed in a generally square shape in plan using a resin material, has upper and lower side faces 5*d,* as shown in FIG. 6A. At one end located on the right-hand side of the second lever 5 are formed a pair of first retaining portions 5*a* as upper and lower protrusions, while at the opposite end located on the left-hand side of the second lever are formed a pair of second retaining portions 5*b* also as upper and lower protrusions.

As shown in FIG. 6B, the first retaining portions 5*a* are each formed in an oval shape having a narrow portion 5*g* and a wide portion 5*h,* the narrow portion 5*g* being formed in parallel with the longitudinal direction of the second lever 5 and the wide portion 5*h* formed perpendicularly to the longitudinal direction of the second lever.

The second retaining portions 5*b* are each formed in a generally elliptic shape whose size is larger in the transverse direction than in the vertical direction.

As shown in FIG. 6A, the second lever 5 has a relatively large circular hole 5*c* formed in a position closer to the second retaining portions 5*b,* that is, closer to the left-hand side. An elastic member 7, which will be described later, is to be positioned in the circular hole 5*c*.

A pair of columnar pivot shafts 5*e* projecting outwardly from the side faces 5*d* are formed at positions close to the first retaining portions 5*a*.

The pivot shafts 5*e* of the second lever 5 are fitted in the shaft bearing portions 4*e* formed as circular holes of the first lever 4, whereby the first and second levers 4, 5 are assembled together crosswise as in FIG. 2.

Further, the first retaining portions 4*a* of the first lever 4 are pivotably engaged with the first engaging portions 2*a* of the substrate 2, and the second retaining portions 5*a* of the second lever 5 are slidably engaged with the second engaging portions 2*b* of the substrate 2, whereby the first and second levers 4, 5 are made movable vertically.

A key top 6 held by the first and second levers 4, 5 and having first and second engaging portions 6*b,* 6*c* is formed of a resin material. As shown in FIGS. 7 and 8, the first engaging portion 6*b* is formed in a pair on the right-hand side in the figures on the back 6*a* of the key top 6, while on the left-hand side is formed the second engaging portion 6*c* (also in a pair).

The first engaging portions 6*b* each comprise two engaging walls 6*d,* which are formed opposedly to each other so as to define therebetween a first gap 6*e* of width C and a second gap 6*f* of a larger width D.

The second engaging portions 6*c* located on the left-hand side of the first engaging portions 6*b* are each formed in a general L shape one side of which is open to form a slide slot 6*g*.

As shown in FIG. 8, the first and second engaging portions 6*b,* 6*c* are formed on the back 6*a* of the key top 6 projectingly and opposedly to each other. The second engaging portions 6*c* are formed so that their slide slots 6*g* are inwardly opposed to each other.

Cap positioning portions 6*h* are formed projectingly at a nearly central position of the back 6*a* of the key top 6 shown in FIG. 8. The cap positioning portions 6*h* are formed by dividing a circular shape crosswise into four portions.

The first retaining portions 4*a* formed at one end side of the first lever 4 are pivotably secured to the substrate 2 side, the first retaining portions 5*a* formed at one end side of the second lever 5 are pivotably secured to the key top 6 side, the second retaining portions 5*b* formed at the opposite end side of the second lever 5 are slidably secured to the substrate 2 side, and the first and second levers 4, 5 are combined together crosswise through the shaft bearing portions 4*e* and the pivot shafts 5*e* formed between one ends and the opposite ends of both levers, whereby the key top 6 is held on the substrate vertically movably in a substantially horizontal state through the first and second levers 4, 5.

An elastic member 7 which urges the key top 6 upward elastically is adhered, with an adhesive or the like, onto the membrane switch 3 at a position between the first and second engaging portions 2*a,* 2*e* of the substrate 2. The elastic member 7 is constituted by an insulating rubber cap and, as shown in FIG. 2, a domed cavity 7*a* being formed in the interior of the elastic member, with a downwardly extending projection 7*b* being formed in the cavity 7*a*. An upper end portion 7*c* of the elastic member 7 is established its position by the cap positioning portions 6*h* located at the back of the key top 6. In this way the keyboard assembly is constituted.

The keyboard assembly constructed as above operates in the following manner. When the key top 6 is depressed, the first retaining portions 4*a* and 5*a* of the first and second levers 4, 5 move pivotally at the first engaging portions 2*a* and 6*b* of the substrate 2 and the key top 6, respectively, while the second retaining portions 4*c* and 5*b* of the first and second levers slide at the second engaging portions 6*c*, 2*e* of the key top 6 and the substrate 2, respectively, so that the first and second levers 4, 5 pivotally move downward into a substantially horizontal state.

At the same time, the elastic member 7 is collapsed by the depressed key top 6, the projection 7*b* formed within the cavity 7*a* goes down, and the upper sheet 3*a* is pressed by the projection 7*b,* so that the movable contact (not shown) formed on the upper sheet 3*a* comes into contact with the fixed contact (not shown) formed on the lower sheet 3*b*, whereby the membrane switch 3 is turned ON.

Upon subsequent relief of the depressing pressure applied to the key top 6, the first and second levers 4, 5 and the key top 6 are forced back to their original states with the elastic force of the elastic member 7, while at the same time the upper sheet 3*a* which has been depressed by the projection 7*b* of the elastic member 7 moves out of contact with the lower sheet 3*b* and reverts to its original state by its own restoring force, whereby the membrane switch turns OFF.

The keyboard assembly being considered is assembled in the following manner. First, the membrane switch 3 is put on the substrate 2. Then, as shown in FIG. 9, the first lever 4 is stood nearly upright, the narrow portion 4*g* of each first retaining portion 4*a* is inserted into the second gap 2*d* of width B through the first gap 2*c* of width A both formed in the associated first engaging portion 2*a*, and thereafter the first lever 4 is moved pivotally in the arrow E direction, allowing the first retaining portion 4*a* of the first lever to be pivotably engaged with the first engaging portion 2*a* of the substrate 2.

Next, while the first lever 4 engaged with the first engaging portions 2*a* is left brought down onto the substrate 2, the second lever 5 is tilted at a predetermined angle as shown in FIG. 2, and in this state the second retaining portions 5*b* are slid into the slide slots 2*f* of the second engaging portions 2*e*.

When the second lever 5 is depressed with its pivot shafts 5*e* positioned on the guide portions 4*f* of the first lever 4, the arm portions 4*b* of the first lever 4 undergo an elastic deformation and the pivot shafts 5*e* of the second lever 5 are brought into snap-engagement with the shaft bearing portions 4*e* of the first lever 4. As a result, the first and second levers 4, 5 are combined together crosswise into such an X shape as shown in FIG. 2 through the shaft bearing portions 4*e* and the pivot shafts 5*e*.

Next, the elastic member 7 constituted by a rubber cap is inserted into the large circular hole 5*c* of the second lever 5 and is fixed onto the membrane switch 3 with an adhesive or the like.

Then, the left-hand side of the key top 6 which is in the state shown in FIG. 7 is lifted and the right-hand side thereof is brought down, thus causing the key top to be tilted at a predetermined angle. Subsequently, the narrow portions 5*g* of the first retaining portions 5*a* of the second lever are inserted respectively through the first gaps 6*e* of width C formed in the first engaging portions 6*b* of the key top 6 into the second gaps 6*f* of width D, whereby the first retaining portions 5*a* are pivotably engaged with the first engaging portions 6*b*.

Upon subsequent insertion of the second retaining portions 4*c* of the first lever 4 into the slide slots 6*g* of the second engaging portions 6*c* of the key top 6, the first and second levers 4, 5 become pivotable vertically with the shaft bearing portions 4*e* of the first lever 4 and the pivot shafts 5*e* of the second lever 5 as fulcrums. Through the first and second levers 4, 5 the key top 6 can be held vertically movably in a substantially horizontal state.

Although in the above embodiment both first retaining portions 4*a* and 5*a* of the first and second levers are formed in an oval shape and the first and second gaps are formed in each of the first engaging portions 2*a* and 6*b* of the substrate 2 and the key top 6, a modification may be made such that the first retaining portions of only one of the first and second levers 4, 5 are formed in an oval shape, while the first retaining portions of the other are formed in a columnar shape, and the first engaging portions of only one of the substrate 2 and the key top 6 are each formed by the first and second gaps, while the first engaging portions of the other are each formed as a circular hole.

In other words, there may be adopted a construction wherein the first engaging portions 2*a* and/or 6*a* of the substrate 2 and/or the key top 6 each have two engaging walls formed opposedly to each other with a gap therebetween and the first retaining portions 4*a* and/or 5*a* of the first lever 4 and/or the second lever 5 are each inserted through the gap into pivotable engagement with the first engaging portions 2*a* and/or 6*a* of the substrate 2 and/or the key top 6.

According to the keyboard assembly of the present invention, as set forth hereinabove, since the first engaging portion of the substrate and/or the key top comprises two engaging walls formed opposedly to each other with a gap therebetween and the first retaining portion of the first lever and/or the second lever is inserted through the gap into pivotable engagement with the first engaging portion of the substrate and/or the key top, the first lever and/or the second lever can be smoothly inserted for assembly into the first engaging portion of the substrate and/or the key top. Thus, it is possible to provide a keyboard device superior in assemblability.

Moreover, since the first retaining portion of the first and/or the second lever is formed in an oval shape having a narrow portion and a wide portion, the narrow portion being formed in parallel with the longitudinal direction of the first and/or the second lever, the wide portion being formed perpendicularly to the longitudinal direction of the first and/or the second lever, and the narrow portion is inserted through the gap of the first engaging portion of the substrate and/or the key top, allowing the wide portion to be pivotably engaged with the first engaging portion, the narrow portion of the first retaining portion of the first and/or the second lever can be inserted smoothly into the first engaging portion of the substrate and/or the key top, allowing the wide portion of the first retaining portion to function as an anti-dislodgment means in the first engaging portion of the substrate and/or the key top.

Further, since the first engaging portion of the substrate and/or the key top comprises a first gap which permits insertion therein of the narrow portion of the first retaining portion of the first and/or the second lever and a second gap which is wider than the first gap and which permits a pivotable motion therein of the wide portion of the first retaining portion, the wide portion of the first retaining portion of the first and/or the second lever can be moved pivotally in the second gap of the substrate and/or the key top while ensuring dislodgment thereof.

Further, since the narrow portion of the first retaining portion is inserted into the second gap through the first gap in the first engaging portion of the substrate and/or the key top and thereafter the wide portion of the first and/or the second lever is brought into pivotable engagement with the second gap in the first engaging portion of the substrate and/or the key top, the first and/or the second lever can be smoothly inserted for assembly into the first engaging portion of the substrate and/or the key top, thus permitting the provision of a keyboard assembly superior in assemblability.

What is claimed is:

1. A keyboard assembly comprising:

a key top having first and second engaging portions and held vertically movably on a substrate which has first and second engaging portions;

an elastic member which urges said key top upward; and first and second levers which hold said key top vertically movably, said first and second levers being combined together crosswise through a pivot shaft portion formed between a one end and an opposite end of each of the first and second levers, said first lever having a first retaining portion for pivotal engagement of the one end of the first lever with said first engaging portion of said substrate and also having a second retaining portion for slidable engagement of the opposite end of the first lever with said second engaging portion of said key top, said second lever having a first retaining portion for pivotal engagement of the one end of the second lever with said first engaging portion of said key top and also having a second retaining portion for slidable engagement of the opposite end of the second lever with said second engaging portion of said substrate, said first engaging portion of said substrate comprising two engaging walls opposed to each other through a gap, said first retaining portion of said first lever being inserted through said gap and into pivotal engagement with said first engaging portion of said substrate, said first retaining portion of said first lever being formed in an oval shape having a narrow portion and a wide portion, said narrow portion being formed in parallel with a longitudinal direction of said first lever, said wide portion being formed perpendicularly to the longitudinal direction of the first lever, said narrow portion being inserted through said gap and said wide portion being brought into pivotal engagement with said two engaging walls.

2. A keyboard assembly according to claim 1, wherein said first engaging portion of said substrate comprises a first gap into which said narrow portions of said first retaining portion of said first lever and/or said second lever can be inserted and a second gap which is wider than said first gap and in which said wide portion of said first retaining portion is pivotable pivotally engaged.

3. A keyboard assembly according to claim 2, wherein said narrow portion is inserted from said first gap into said second gap, and said wide portion is brought into pivotal engagement with said second gap.

4. A keyboard assembly comprising:

a key top having first and second engaging portions and held vertically movably on a substrate which has first and second engaging portions;

an elastic member which urges said key top upward; and first and second levers which hold said key top vertically movably, said first and second levers being combined together crosswise through a pivot shaft portion formed between a one end and an opposite end of each of the first and second levers, said first lever having a first retaining portion for pivotal engagement of the one end of the first lever with said first engaging portion of said substrate and also having a second retaining portion for slidable engagement of the opposite end of the first lever with said second engaging portion of said key top, said second lever having a first retaining portion for pivotal engagement of the one end of the second lever with said first engaging portion of said key top and also having a second retaining portion for slidable engagement of the opposite end of the second lever with said second engaging portion of said substrate, said first engaging portion of said key top comprising two engaging walls opposed to each other through a gap, said first retaining portion of said second lever being inserted through said gap and into pivotal engagement with said first engaging portion of said key top, said first retaining portion of said second lever being formed in an oval shape having a narrow portion and a wide portion, said narrow portion being formed in parallel with a longitudinal direction of said second lever, said wide portion being formed perpendicularly to the longitudinal direction of the second lever, said narrow portion being inserted through said gap and said wide portion being brought into pivotal engagement with said two engaging walls.

5. A keyboard assembly according to claim 4, wherein said first engaging portion of said key top comprises a first gap into which said narrow portions can be inserted and a second gap which is wider than said first gap and in which said wide portion is pivotally engaged.

6. A keyboard assembly according to claim 5, wherein said narrow portion is inserted from said first gap into said second gap and said wide portion is brought into pivotal engagement with said second gap.

7. A keyboard assembly comprising:

a key top having first and second engaging portions and held vertically movably on a substrate which has first and second engaging portions;

an elastic member which urges said key top upward; and first and second levers which hold said key top vertically movably, said first and second levers being combined together crosswise through a pivot shaft portion formed between a one end and an opposite end of each of the first and second levers, said first lever having a first retaining portion for pivotal engagement of the one end of the first lever with said first engaging portion of said substrate and also having a second retaining portion for slidable engagement of the opposite end of the first lever with said second engaging portion of said key top, said second lever having a first retaining portion for pivotal engagement of the one end of the second lever with said first engaging portion of said key top and also having a second retaining portion for slidable engagement of the opposite end of the second lever with said second engaging portion of said substrate, said first engaging portions of said substrate and said key top each comprising two engaging walls opposed to each other through a gap, said first retaining portions of said first and second levers being inserted through said gap and into pivotal engagement with said first engaging portions of said substrate and said key top, respectively, said first retaining portions each being formed in an oval shape having a narrow portion and a wide portion, said narrow portion of said first retaining portion of said first lever being formed in parallel with a longitudinal direction of said first lever, said narrow portion of said first retaining portion of said second lever being formed in parallel with a longitudinal direction of said second lever, said wide portion of said first retaining portion of said first lever being formed perpendicularly to the longitudinal direction of the first lever, said wide portion of said first retaining portion of said second lever being formed perpendicularly to the longitudinal direction of the second lever, said narrow portion of said first retaining portion of said first lever being inserted through said gap of said first engaging portion of said substrate and said wide portion of said first retaining portion of said first lever being brought into pivotal engagement with said two engaging walls of said first engaging portion of said substrate, said narrow portion of said first retaining portion of said second lever being inserted through said gap of said first engaging portion of said key top and said wide portion of said first retaining portion of said second lever being brought into pivotal engagement with said two engaging walls of said first engaging portion of said key top.

8. A keyboard assembly according to claim 7, wherein said first engaging portions of said substrate and said key top each comprise a first gap into which said narrow portion can be inserted and a second gap which is wider than said first gap and in which said wide portion is pivotally engaged.

9. A keyboard assembly according to claim 8, wherein said narrow portion of said first retaining portion of said first lever is inserted from said first gap into said second gap of said first engaging portion of said substrate, and said wide portion of said first retaining portion of said first lever is brought into pivotal engagement with said second gap of said first engaging portion of said substrate, said narrow portion of said first retaining portion of said second lever is inserted from said first gap into said second gap of said first engaging portion of said key top, and said wide portion of said first retaining portion of said second lever is brought into pivotal engagement with said second gap of said first engaging portion of said key top.

* * * * *

UNITED STATES PATENT AND TRADEMARK OFFICE

CERTIFICATE OF CORRECTION

PATENT NO. : 6,236,003 B1
DATED : May 22, 2001
INVENTOR(S) : Shoji Suganami

It is certified that error appears in the above-identified patent and that said Letters Patent is hereby corrected as shown below:

Column 9,
Lines 29 and 30, delete "portions of said first retaining portion of said first lever and/or said second lever" and substitute -- portion -- in its place.
Line 32, delete "of said first retaining portion".

Signed and Sealed this

Fourteenth Day of May, 2002

*Attest:*

*Attesting Officer*

JAMES E. ROGAN
*Director of the United States Patent and Trademark Office*